United States Patent [19]

Ratcliffe et al.

[11] 4,235,699

[45] Nov. 25, 1980

[54] SOLUBILIZATION OF COAL WITH HYDROGEN SULFIDE AND CARBON MONOXIDE

[75] Inventors: Charles T. Ratcliffe, Morristown; Mahmoud B. Abdel-Baset, New Providence, both of N.J.

[73] Assignee: Allied Chemical Corporation, Morris Township, Morris County, N.J.

[21] Appl. No.: 17,514

[22] Filed: Mar. 5, 1979

[51] Int. Cl.[3] ..... C10G 1/00; C10G 45/00; C10G 47/00

[52] U.S. Cl. ..... 208/8 LE; 208/56; 208/107; 208/8 R

[58] Field of Search ..... 208/8 R, 8 LE, 10, 56, 208/107

[56] References Cited

U.S. PATENT DOCUMENTS

| | | | |
|---|---|---|---|
| 3,030,297 | 4/1962 | Schroeder | 208/8 R |
| 3,503,863 | 3/1970 | Gotsis | 208/8 LE |
| 3,640,816 | 2/1972 | Bull et al. | 208/10 |
| 3,796,653 | 3/1974 | Gotsis | 208/107 |
| 3,954,596 | 6/1976 | Schroeder | 208/8 R |
| 4,077,867 | 3/1978 | Aldridge et al. | 208/10 |
| 4,094,765 | 6/1978 | Bearden et al. | 208/8 LE |
| 4,115,075 | 9/1978 | McNamee et al. | 208/8 LE |
| 4,159,936 | 7/1979 | Dorn et al. | 208/107 X |

FOREIGN PATENT DOCUMENTS

| | | | |
|---|---|---|---|
| 2820087 | 12/1978 | Fed. Rep. of Germany | 208/8 LE |

*Primary Examiner*—Delbert E. Gantz
*Assistant Examiner*—William G. Wright
*Attorney, Agent, or Firm*—Robert A. Harman

[57] ABSTRACT

Conversion of coal to products soluble in common solvents and conversion of coal tar to products of lower molecular weight, effected in liquid or fused reaction medium using a hydrogenating reactant, are carried out employing hydrogen sulfide and carbon monoxide as the sole or major hydrogenating reactant, without need of elemental hydrogen or a hydrogen donor solvent.

7 Claims, No Drawings

SOLUBILIZATION OF COAL WITH HYDROGEN SULFIDE AND CARBON MONOXIDE

BACKGROUND OF THE INVENTION

This invention relates to the conversion of coal and/or coal tar to products of lower molecular weight than the starting material and soluble in solvents such as ethyl acetate, benzene and other common solvents.

PRIOR ART

It is generally known in the coal liquefaction art, to mix pulverized coal with a hydrogen donor solvent, such as a fraction of recycled oil produced in the process, and with a catalyst if desired and then heat to a temperature in the range of 400° to 500° C. under a hydrogen pressure in the range of 2000 to 10,000 psi. The obvious disadvantage of such processes is the requirement of expensive hydrogen needed to hydrogenate the coal and to rehydrogenate the hydrogen donor solvent. It would be desirable to provide a method to hydrogenate and thus solubilize coal without use of elemental hydrogen either directly in the process, or for rehydrogenating a hydrogen donor solvent.

The only experimentally tested process of which we are aware, capable of coal solubilization without using elemental hydrogen, is the COSTEAM process developed at Pittsburgh Energy Research Center (Article by H. R. Appell, E. C. Moroni and R. D. Miller, ACS, Fuel Chem. Div., Preprints, vol. 20, No. 1, page 58 (1975)). In this process low rank coal such as lignite and subbituminous coal are converted to benzene-soluble products by use of carbon monoxide, or synthesis gas, and water at temperatures such as 300° C.–460° C. in presence of a hydrogen donor solvent such as anthracene oil.

It has been claimed that coal in finely divided form can be at least partially converted to products soluble in certain common solvents by action of elemental hydrogen and hydrogen sulfide at elevated temperature and pressure in a hydrogen donor solvent, using a catalyst if desired, in particular a hydrogenation catalyst. Use of hydrogen sulfide without added hydrogen is also suggested in the same patent. (U.S. Pat. No. 3,503,863 of Mar. 31, 1970 to J. G. Gatsis; see col. 3, lines 17–40 and col. 5, lines 3–20.)

A related proposal is to pretreat a slurry of coal at elevated temperature with hydrogen sulfide under pressure, and after removal of the hydrogen sulfide, subject the product to liquefaction conditions using hydrogen gas and a hydrogen donor diluent. (U.S. Pat. No. 4,094,765 of June 13, 1978 to R. Bearden, Jr., et al.) As a modification, an oil-soluble metal compound catalyst can be included in the reaction mixture whereby the hydrogen content of the hydrogen donor solvent is replenished by in situ reaction of the depleted solvent with elemental hydrogen. (U.S. Pat. No. 4,077,867 of Mar. 7, 1978 to C. L. Aldridge and R. Bearden.) In these operations, hydrogen sulfide in minor proportions (1–30 mole percent) may be contained in the gas comprising hydrogen used for the coal liquefaction (col. 5, lines 8–11); and especially when the coal employed contains water, it is stated to be desirable to utilize a raw synthesis gas, comprising hydrogen and carbon monoxide, as the source of hydrogen for the process (col. 5, lines 1–4). Reaction of the carbon monoxide with the water is stated to form $CO_2$ and additional hydrogen which aided in the liquefaction (col. 8, lines 23–30).

It is clear that in the foregoing prior art, hydrogen sulfide is being used only as a promoter of such hydrogen sources as elemental hydrogen and/or hydrogen donor solvents.

SUMMARY OF THE INVENTION

There is a need for efficient and economical reagents for the hydrogenation and solubilization of coal and conversion of coal tar as above. In accordance with this invention, the solubilization of coal and conversion of coal tar to products of lower molecular weight, effected in liquid or fused reaction medium using a hydrogenation reactant, are carried out employing reactant consisting essentially of hydrogen sulfide and carbon monoxide as the sole or major hydrogenating reactant, without need of elemental hydrogen or a hydrogen donor solvent. Specifically, conversion of lignite, subbituminous coal and high volatile bituminous coal to products soluble in ethyl acetate is accomplished by using a hydrogenating agent which consists essentially of hydrogen sulfide and carbon monoxide. The conversion to soluble products was increased, for example, from 12.5% using only a nitrogen atmosphere (see Table below, run 1) to 38.2% by using carbon monoxide and hydrogen sulfide (run 2). Moreover whereas use of hydrogen sulfide alone gave a slight increase in conversion from 12.5% (run 1) to 18% (run 5), such operation caused a substantial increase in the sulfur content of the product, from 3.36% (run 1) to 6.34% (run 5) but the addition of carbon monoxide to the hydrogen sulfide decreased this sulfur content to 4.33% while increasing the conversion, as above noted, to 38.2% (run 2). The use of a larger quantity of hydrogen sulfide along with carbon monoxide increased the conversion even further to 46.6% (run 8) with only a slight increase in the sulfur content to 4.85%. The conversion was 28% using carbon monoxide and water (run 9) vs. 38.2%, as above noted, under like conditions using carbon monoxide and hydrogen sulfide in accordance with this invention (run 2).

DETAILED DESCRIPTION

In particular, when using $H_2S/CO$ as hydrogenating agent in accordance with this invention, materials which can be used as the reaction medium are nonhydrogen donor diluents as known in the art, especially such compounds as aromatic hydrocarbons including alkylbenzenes, alkylnaphthalenes, alkylated polycyclic aromatics, heteroaromatics, and mixtures thereof and streams such as unhydrogenated creosote oil. Hydrogen donor diluents can also be used, for example partially hydrogenated cyclic hydrocarbons such as tetrahydronaphthalene, partially hydrogenated aromatic hydrocarbons such as hydrogenated methylnaphthalene, hydrogenated dimethylnaphthalene, hydrogenated $C_{12}$ and $C_{13}$ acenaphthenes and the hydrogenated product streams from coal liquefaction (U.S. Pat. No. 4,094,765 col. 1, line 61- col. 2, line 16). Tetrahydronaphthalenes and anthracene oil are particularly good hydrogen donor diluents which can be used as the reaction medium, mixed or not with nonhydrogen donor diluents in the process of this invention. The only requirement of the reaction medium is that it serve as a liquid dispersing medium of hydrogen sulfide and carbon monoxide reactants for contact with the coal or coal tar without decomposing the reactants and that it be itself essentially stable against cracking under the reaction conditions. Useful reaction media will comprise in general at least one high boiling compound having an aromatic nucleus and having atmospheric pressure boiling point of at least 200° C., or hydrogenation product thereof.

A preferred substrate for use in this invention as the coal to be solubilized is coal having fixed carbon content between 35% and 70% by weight, moisture free, especially high volatile bituminous coal. Favorable results also are obtained by use of subbituminous coal, lignite, and coal tar as the substrate.

Pressures to be used under operating conditions in the subject process are broadly in the range 500 to 5,000 psi (3,447 to 34,470 kilopascals) as known for operation using hydrogen sulfide/hydrogen, more typically in the range 2,000–3,000 psi (about 13,790–20,680 kPa). Suitable reaction temperatures, as known for prior art use of hydrogen sulfide/hydrogen coal liquefaction processes, are between 250° C. and the coking temperature (about 550° C.) especially in the range 350° C.–450° C.

Desirable initial weight ratios to be employed are hydrogen sulfide:dry coal between 0.1:1 and 20.1. The proportion of carbon monoxide:hydrogen sulfide is not a critical variable in our process, but will be adjusted to give good results at desired pressures. Suitable proportions are between 5:95 parts and 95:5 parts by weight of $CO:H_2S$.

The use of catalysts is helpful, particularly in reducing the content of sulfur in the liquefied coal fraction (the asphaltenes). Catalysts which can be used are in general sulfur-resistant hydrodesulfurization catalysts such as cobalt-molybdenum oxides supported on alumina.

Elemental hydrogen need not be excluded from the $H_2S/CO$ reactant used in our process, but since it is relatively expensive at least in purified form, it will not ordinarily be specially added to provide part of the reactant. However if it is desired to use hydrogen sulfide and/or carbon monoxide containing a minor proportion of elemental hydrogen, that can be done without losing the benefit of our process.

EXAMPLES

In Table 1 which follows, runs 1–9 utilizing the process of the invention and comparison runs are tabulated. These runs were carried out in a 300 cc magnetically stirred autoclave reactor. The coal used in the runs was a high volatile bituminous coal of ultimate analysis (moisture free) by weight carbon 69.35%, ash 11.05%, oxygen 9.81%, hydrogen 4.98%, sulfur 3.57%, nitrogen 1.23%, and chlorine 0.01%. The proximate analysis (moisture free) by weight was volatiles 37.85%, fixed carbon 47.24%, ash 14.91% and sulfur 3.69%.

A 20 gram sample of the coal pulverized to pass through 120 mesh (U.S. standard sieve series) was employed. The reaction medium was 1-methylnaphthalene (80 g). Hydrogen sulfide was introduced into the reactor in 4.5 gram quantity. The reactor was then pressurized at ambient temperature with carbon monoxide to 1,000 psig (6,895 kPa) and was heated to about 400° C., bringing the pressure to about 2100 psig (about 14,480 kPa).

After a reaction time of 2 hours, the contents of the autoclave were transferred into an extraction thimble and extracted using ethyl acetate for a period of 24 hours. The thimble was then dried in vacuum and weighed to determine the weight of residue.

The percent conversion "C" to product soluble in ethyl acetate, based on dry coal, is given by 100 times (the difference in weight of dry coal charged minus weight of residue), all divided by weight of dry coal charged; and from this, the conversions "DAFC" based on dry, ash-free coal, given in the Table, are calculated using percent ash in dry coal:

$$C = 100 \times (\text{wgt dry coal} - \text{wgt residue})/\text{wgt dry coal};$$

$$DAFC = 100(C)/(100 - \%\ \text{ash in dry coal})$$

In Table 2, runs 10–13 are tabulated, performed under the same conditions as for runs 1–9 except as otherwise indicated in Table 2. In these runs a different high volatile bituminous coal was used having proximate analysis as follows in weight percent:

As received
- Moisture—8.17
- Ash—11.53
- Sulfur—2.74

Dry Basis
- Volatile—36.12
- Fixed carbon—51.34

TABLE 1

| Run | Coal | Temp. °C. | Time | Reactants, Catalyst | DAFC (% Conversion | Total Sulfur |
|---|---|---|---|---|---|---|
| 1 | HVC Bituminous | 400 | 2 hrs | $N_2$ only | 12.5 | 3.364 |
| 2 | HVC Bituminous | " | 2 hrs | $H_2S/CO$ | 38.2 | 4.33 |
| 3 | HVC Bituminous | " | 2 hrs | $H_2S/CO$ . Co/Mo[a] | 37.1 | 3.86 |
| 4 | HVC Bituminous | " | 2 hrs | $H_2S/CO;(NH_4)_2MoO_4$[b] | 41.8 | 3.92 |
| 5 | HVC Bituminous | " | 2 hrs | $H_2S$ only | 18.0 | 6.34 |
| 6 | HVC Bituminous | " | 2 hrs | $H_2S/CO$,Co/Mo[a] + $K_2CO_3$ | 32.4 | 4.40 |
| 7 | Coal tar[c] | " | 2 hrs | $H_2S/CO$,Co/Mo + $K_2CO_3$ | (d) | |
| 8 | HVC Bituminous | " | 2 hrs | $H_2S$ (25g), CO and Co/Mo[a] catalyst | 46.6 | 4.85 |
| 9 | HVC Bituminous | " | 2 hrs | $H_2O$ + CO[e] | 28.0 | 4.03 |

[a]Harshaw HT-400E. 3% Co, 12% Mo oxides on $Al_2O_3$
[b]Wet impregnated on the coal followed by vacuum drying
[c]Material from coke operation
[d]Liquid of much lower viscosity, different aromatic structure and higher aliphatic content as observed by proton nmr and $^{13}C$-nmr spectra, vs. the original tar.
[e]$H_2O$ quantity was 2.4 grams, to provide same molar quantity as 4.5 grams of $H_2S$. Pressure at ambient temperature was bought to about 1000 psig, as before, with carbon monoxide.

TABLE 2

Solubilization of Illinois No. 6 Coal Delta Mine, AMAX Coal Company.
Liquefaction at 400° C. for 2 hours, 20g coal, 80g solvent.

| Run No. | Conditions | % Conversion (daf) |
|---|---|---|
| 10 | 1-methylnaphthelene, $N_2$ | 38.6 |
| 11 | 1-methylnaphthalene, $H_2S/CO$ + catalyst(/) | 58.25 |
| 12 | Tetralin, $N_2$ | 73.4 |
| 13 | Tetralin, $H_2S/CO$ + Catalyst(/) | 82.75 |

(/)Harshaw HT-400E (as in footnote (a) of TABLE 1) impregnated with 5% $K_2CO_3$)

As will be seen from Run 2 vs. Run 5 of Table 1, the use of carbon monoxide greatly increases the conversion of the coal to soluble products, vs. use of hydrogen sulfide without added carbon monoxide. Run 8 shows still higher conversion, when a larger amount of hydrogen sulfide was employed, and the reactor was pressurized with carbon monoxide to 1000 psig at ambient temperature as before. Certain runs of the Table, using catalyst, show somewhat lower sulfur in the product than obtained in the absence of catalyst.

The results in Table 2 confirm the enhancement of the solubility of coal by use of $H_2S/CO$. Run 13 demonstrates the superior solubilization of coal with $H_2S/CO$ treatment in the presence of a donor solvent as compared to run 12. It is again seen that a donor solvent, while advantageous for high conversion, is not necessary, as run 11 has allowed more than 58% conversion of coal to a soluble product.

Use of $H_2S/CO$ greatly enhances the coal solubility vs. use of a nitrogen atmosphere, as seen in Table 1, run 2 vs. run 1 and in Table 2, run 11 vs. run 10.

We claim:

1. In a process for conversion, in liquid or fused reaction medium using a hydrogenating reactant, of a substrate of the group consisting of coal and coal tar and mixtures thereof to products of lower molecular weight than the starting material and soluble in ethyl acetate: the improvement which comprises employing as the sole hydrogenating reactant, such reactant consisting essentially of hydrogen sulfide and carbon monoxide.

2. Process in accordance with claim 1 wherein the reaction medium consists essentially of at least one high boiling compound having an aromatic nucleus and having atmospheric pressure boiling point of at least 200° C.

3. Process in accordance with claim 1 wherein the substrate is coal tar.

4. Process in accordance with claim 2 wherein the substrate is coal having fixed carbon content in the range between 35% and 70% by weight, moisture-free.

5. Process in accordance with claim 4 wherein the substrate is high volatile bituminous coal and the reaction medium is 1-methylnaphthalene.

6. Process in accordance with claim 4 wherein the initial weight ratio of hydrogen sulfide: dry coal is between 0.1:1 and 20:1; the operating pressure is 500–5,000 psi (3,447–34,470 kPa) and the reaction temperature is in the range 350°–450° C.

7. Process in accordance with claim 5 wherein the carbon monoxide and hydrogen sulfide reactants are introduced at about 5:1 mole ratio of carbon monoxide:-hydrogen sulfide.

* * * * *